United States Patent [19]

Alvarez

[11] Patent Number: 4,514,999

[45] Date of Patent: May 7, 1985

[54] HEAT RECUPERATOR FOR A STRIP MILL

[76] Inventor: Donald E. Alvarez, 17256 Akita Ct., Strongsville, Ohio 44136

[21] Appl. No.: 540,485

[22] Filed: Oct. 11, 1983

[51] Int. Cl.[3] ..... B21B 41/00; B21B 45/00

[52] U.S. Cl. ..... 72/202; 72/230; 72/231

[58] Field of Search ..... 72/14, 15, 128, 200, 72/202, 231, 250, 230, 252; 242/78, 78.1; 266/103, 106, 252, 253, 256, 262; 432/59, 67, 70, 260

[56] References Cited

U.S. PATENT DOCUMENTS

| | | | |
|---|---|---|---|
| 373,463 | 11/1887 | Lenox | 72/202 |
| 2,091,340 | 8/1937 | Sutherland | 72/128 |
| 3,729,972 | 5/1973 | Kocks | 72/202 X |

*Primary Examiner*—E. Michael Combs

*Attorney, Agent, or Firm*—Renner, Kenner, Greive & Bobak

[57] ABSTRACT

An apparatus for receiving the intermediate product of a rolling finishing mill. The apparatus incorporates an oven (40) to receive the intermediate product from the roughing stand (11) of a rolling mill. A first concave surface (16) of a deflector (13) directs the travel of the intermediate product from the roughing stand (11) to the oven means (40). Driven pinch rolls (36) selectively advances the intermediate product from the deflector (13) to the oven (40). Oscillating guides (44,45) within the oven (40) permit the intermediate product to be foldedly layered therein. When the intermediate product is substantially contained within the oven means (40) it is selectively secured at one end by clamp members (22,23) in a fixed position relative to the deflector (13). The intermediate product thus contained within the oven (40) is maintained at a constant uniform temperature until it is reintroduced into the rolling mill, at which time the driven pinch rolls (36) withdraw the intermediate product from the oven (40). A second concave surface (17) of the deflector (13) redirects the intermediate product into the finishing stand (12), thereby enabling the finishing process to continue.

11 Claims, 2 Drawing Figures

HEAT RECUPERATOR FOR A STRIP MILL

TECHNICAL FIELD

The present invention relates generally to hot strip metal rolling mills. More particularly, the present invention relates to an apparatus to accumulate the strip material during the interval after the strip has exited the roughing stand but before it enters the finishing stand. Specifically, the present invention relates to an apparatus for receiving the strip being finished after it has exited the roughing stand and to maintain the strip at a constant, uniform temperature while it is entering the finishing stand.

BACKGROUND ART

Roll finishing of metal strips or bars is a wellknown processing technique allowing for the continuous mechanical working of the metal until the desired physical dimensions are achieved. Such roll finishing is generally performed when the work metal is at a substantially elevated temperature, i.e., hot rolling, as this permits the most effective method of breaking down the as-cast structure of the ingot, with rolling forces generally tending to be lesser, and cast defects being more easily eliminated. In the case of hot rolling steel, the temperature of the steel may be approximately 1800° F. (982° C.) during the rolling process.

As the work metal passes through the rolls of the mill, a reduction in the thickness of the metal results in a corresponding increase in the length thereof inasmuch as the working volume remains constant. Furthermore, as it is appreciated in the rolling mill industry, the work piece cannot be introduced into the rolls of the finishing stand until after it has completely exited the rolls of the roughing stand. As such, depending upon the physical size of the rough-rolled work piece, a large area is required to accommodate the work piece during this transition period. In addition, because the work piece is at a substantially elevated temperature relative to the ambient temperature, cooling of the work piece will occur, thus affecting the hot rolling process. Particularly, as the work piece cools, scale may form on the exposed surfaces which, during the finishing operation, may result in unacceptable defects or blemishes in the finished strip.

Several methods have been utilized in the past to remedy this problem. One requires the removal of the scale prior to the initiation of the finishing stage. The scale is usually loosened and removed by jets of high pressure water. While this process may adequately remove the scale, it does not correct the underlying problem, namely, the cooling of the strip which results in increased rolling forces needed to complete the rolling process.

The more desirable solution to the scaling and cooling problem is to attempt to maintain the work metal at a constant, uniform temperature. One method is to coil the work strip as it exits the roughing stand. This process allows for a substantially reduced area needed to contain the work strip. Also, because of the juxtaposition of successive coils, less cooling occurs as a result of the reduction of surface area exposed to the ambient temperature. Nevertheless, the coil is not maintained at a constant temperature throughout, resulting in a non-uniform temperature of the strip and thus non-uniform finishing of the work strip.

Another method employed to alleviate the cooling and scaling problem is to apply heat to the entire length of an unfurled strip during the transition from the roughing stand to the finishing stand. This process necessitates a substantial amount of floor space to accommodate the work strip, thus resulting in ungainly, and expensive, rolling mill lines, and buildings in which to house them. Furthermore, an exorbitant amount of heat is required to provide uniform heating of the work strip. This results in an undesirable heating of conveyor rolls and their bearings and additionally is inefficient, and thus expensive, resulting in a vast consumption of fuel to maintain a uniform temperature in the work strip.

Despite the various attempts to maintain a uniform temperature of the work strip during the transition period between the roughing stand and finishing stand, none offers a relatively compact and energy efficient system which can maintain a constant, uniform temperature throughout the entire work piece in addition to providing for the removal of any scale which may form on the surface thereof.

DISCLOSURE OF THE INVENTION

It is, therefore, a primary object of the present invention to provide an apparatus which is suitable for incorporation in a hot strip metal rolling mill and which permits the reception of the work piece as it exits from the roughing stand and maintains the same at a constant, uniform temperature prior to its introduction into the rolls of the finishing stand.

It is another object of the present invention to provide an apparatus, as above, which is relatively compact in size as compared to existing art forms.

It is still another object of the present invention to provide an apparatus, as above, which provides for efficient heating of the work piece during the transition period between the roughing stand and the finishing stand.

It is yet another object of the present invention to provide an apparatus, as above, which reduces formation of scale which may have formed on the work piece prior to the introduction of the latter into the rolls of the finishing stand.

It is a further object of the present invention to provide an apparatus, as above, suitable for incorporation in various types of rolling mills, such as Steckel mills, with minimal modification to the existing mill and with a minimum distance required between the roughing and finishing stands in new mills.

These and other objects of the present invention, as well as the advantages thereof over existing and prior art forms, which will be apparent in view of the following specification, are accomplished by means hereinafter described and claimed.

In general, an apparatus for maintaining the temperature of an intermediate product of a rolling mill according to the concept of the present invention includes an oven to receive the intermediate product from the rolling mill. A deflector directs the intermediate product from the rolling mill to the oven and from the oven back to the rolling mill. A guide member within the oven permits the intermediate product to be substantially contained within the oven and a clamp assembly selectively secures one end of the intermediate product when the intermediate product is substantially contained within the oven.

One preferred embodiment of a strip mill heat recuperator system incorporating the concept of the present invention is shown by way of example in the accompanying drawings without attempting to show all the various forms and modifications in which the invention might be embodied, the invention being measured by the appended claims and not by the details of the specification.

EXEMPLARY EMBODIMENT FOR CARRYING OUT THE INVENTION

Figure 1:
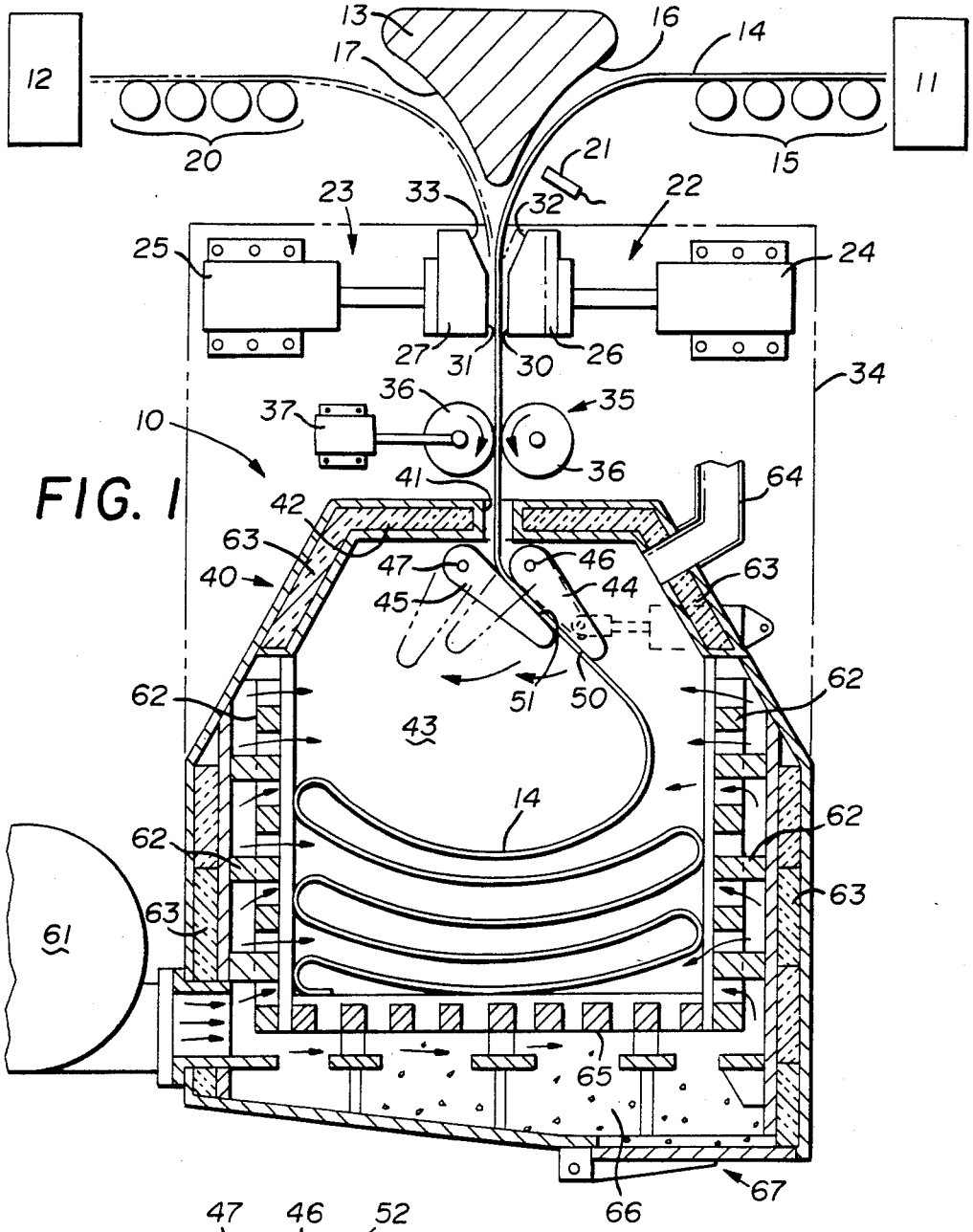
FIG. 1 is an elevational cross-section of a strip mill heat recuperator embodying the concept of the present invention.

A hot strip metal rolling mill heat recuperator system, according to the concept of the present invention, is indicated generally by the numeral 10 in FIG. 1. The rolling mill heat recuperator 10 is suitable for incorporation into an existing roll finishing line having a roughing stand, shown in block representation as numeral 11, and a finishing stand, again in block representation as numeral 12. It should be understood that while the foregoing components of a roll finishing line are essential in the roll finishing process, except environmentally they are not a part of the concept of the present invention.

The strip mill heat recuperator 10 of the present invention, as shown in FIG. 1, employs a deflector 13 to redirect the travel of the work piece 14 downwardly as it is conveyed by rollers 15 from the roughing stand 11. The deflector 13 is preferably a three sided element rigidly secured to the framework of the roll finishing line. A first concave surface 16 is convergingly oriented downward relative to a second concave surface 17. The first concave surface 16 is positioned to receive the work piece 14 in a substantially horizontal orientation as it exits the roughing stand 11. The downward curvature of the first concave surface 16 causes the work piece 14 to follow therealong, exiting the deflector 13 in a substantially vertical orientation traveling downwardly. As will be more fully explained hereinafter in more detail, the second concave surface 17 is likewise positioned to receive the work piece 14 in a substantially vertical orientation traveling upwardly. The curvature of the second concave surface 17 effectively causes the work piece 14 to follow therealong, as with the first concave surface 16, thereby exiting the deflector 13 in a substantially horizontal orientation suitable for introduction to the feed rollers 20 for the finishing stand 12.

While the deflector 13 may preferably be formed from a substantially unitary, rigid member, it should be appreciated that alternative embodiments or modifications may likewise be acceptable. For example, depending upon the specific application, the first concave surface 16 may be defined by a separate and distinct element from the second concave surface 17. Likewise, rollers or guides may be incorporated in or in place of the respective concave surfaces to reduce the frictional forces generated as the work piece 14 traverses therealong. Furthermore, the surfaces may be movable relative to the work piece 14 to provide a more effective angle of attack as the situation may require. Moreover, if desired, deflector 13 can be movably mounted so that the strip could pass directly from the roughing stand 11 to the finishing stand 12.

A proximity sensor 21 is positioned relative to the first concave surface 16 so as to sense the presence of the work piece 14 as it travels from the roughing stand 11, and more particularly to sense the tail end of the work piece 14, for reasons which will become apparent hereinbelow. While FIG. 1 depicts the position of the proximity sensor 21 as opposingly oriented to the first concave surface 16, it should be appreciated that this is but one possible arrangement. Alternative arrangements may find the proximity sensor 21 positioned within the first concave surface 16, or near the rollers 15 of the roughing stand 11, or any other location suitable for detecting the presence of the work piece 14 as it exits the roughing stand 11.

A pair of opposingly oriented clamp and guide assemblies, indicated generally by the numerals 22 and 23, are positioned vertically below the trailing edge of the first concave surface 16. Each clamp and guide assembly 22 and 23, respectively, includes an independently operated actuator 24 and 25, respectively, such as hydraulic cylinders, affixed to slidably oriented clamp heads 26 and 27, respectively. The opposing faces 30 and 31 of the clamp heads 26 and 27 have beveled guide surfaces 32 and 33 located at their uppermost region to facilitate the reception, therebetween, of the work piece 14 as the latter exits from the first concave face 16.

It should be appreciated that the clamp assemblies 22 and 23 can be operated independently or in opposing unison with each other. As such, the work piece can be either directed and positioned laterally of its normal vertical travel or it may be securedly clamped and held, as circumstances may require. Particularly, it should be realized that as the work piece 14 exits downwardly from the first concave surface 16, it is desirable to have the first clamp head 26 fully retracted to accommodate the reception of the work piece 14. In like fashion, when the work piece 14 is being directed upwardly onto the second concave surface 17, it is desirable to have the second clamp head 27 fully retracted while the first clamp head 26 is substantially fully extended, thereby properly directing the work piece 14 toward the second concave surface 17. Furthermore, as it will be appreciated herebelow, it may be desirable to clamp and hold the work piece 14, in which case the first clamp head 26 can be opposingly extended against the extended second clamp head 27 thereby effecting the desired clamping force upon the work piece 14.

The clamp assemblies 22 and 23 may be operatively associated with each other through a common frame member somewhat schematically shown as numeral 34. It should be appreciated that the frame member 34 can vary as to structure and orientation to accommodate the requirements of the particular application. Furthermore, as it will become more apparent with discussion of the other elements of the present invention, the frame member 34 represents the common association of the elements relative to each other as to positioning and orientation.

Positioned below clamp and guide assemblies 22 and 23 is a driven pinch roll assembly generally indicated by the numeral 35 which is of the type commonly used in roll finishing lines. Pinch roll assembly 35 includes a pair of opposingly driven rolls 36 and a positioning actuator 37, such as a hydraulic cylinder. The pinch rolls 36 are suitably oriented to receive the work piece 14 as it exits from the clamp assemblies 22 and 23. The rolls 36 are capable of selective reversible rotation such that they may selectively advance the work piece 14 upwardly or downwardly as desired. Furthermore, it should be realized that the positioning actuator 37 may disengage the rolls 36 from the work piece 14 to permit free travel of the latter through the pinch rolls 36.

The pinch rolls 36 are suitably positioned to direct the work piece 14 to, or from, an oven assembly 40 of a size suitable for receiving substantially the entire work piece 14. Oven assembly 40 can be any of a number of varieties of conventional ovens and is shown as a substantially enclosed structure being sufficiently insulated to efficiently retain the heat dispersed therein and has an opening 41 in the roof 42 thereof suitably positioned relative to the pinch rolls 36 to allow the introduction of the work piece 14 into the oven cavity 43. A pair of oscillating guides 44 and 45 are positioned within the oven cavity 43 in line with the opening 41 to receive the work piece 14 as it is introduced into the oven cavity 43.

The oscillating guides 44 and 45 are preferably paddle-like members extending transversly approximately the full width of the work piece 14 and are rigidly secured to pivotal shafts 46 and 47, respectively, which extend through, and are thus supported by, opposite walls of the oven assembly 40. As such, the oscillating guides 44 and 45 are oriented relative to each other, such that the guide surface 50 of the first oscillating guide 44 is substantially parallel to the guide surface 51 of the second oscillating guide 45, and are spaced apart a sufficient distance from each other to permit the work piece 14 to pass therebetween.

Figure 2:
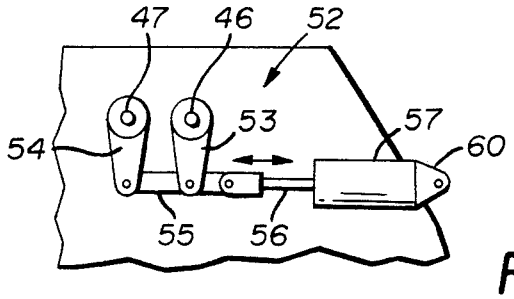
FIG. 2 is a fragmentary elevational view of a typical oscillating guide drive means of the strip mill heat recuperator depicted in FIG. 1.

As best shown in FIG. 2, an external drive mechanism, generally indicated by the numeral 52, imparts a uniform recipricatory pendular motion to the oscillating guides 44 and 45 through the respective pivotal shafts 46 and 47. External drive mechanism 52 includes parallel oriented crank levers 53 and 54 rigidly affixed at one end to the respective pivotal shafts 46 and 47, and rotatably pinned at the other end to a drive bar 55. The drive bar 55 is pivotally joined at one end to a cylinder rod 56 of a reciprocating actuator 57, such as a hydraulic cylinder, which is itself pivotally affixed at its clevis bracket 60 to the exterior of the oven assembly 40. As such, it should be appreciated that a reciprocal rectilinear movement of the cylinder rod 56 will cause a corresponding oscillating pendular movement of the oscillating guides 44 and 45. Furthermore, it should be recognized that when the reciprocating actuator 57 is deenergized, the oscillating guides 44 and 45 are free to follow the curvature of the work piece 14 with little resistive force, as will be more completely detailed hereinbelow.

Other appurtenances associated with the oven assembly 40 include a heating device 61 to generate sufficient influx of heat, usually in the form of hot air, to maintain the work piece 14 at a desired temperature. As shown, hot air from heating device 61 is blown into oven 40 and through a grating 62 into oven cavity 43. Suitable insulation 63 is provided around approximately the entire perimeter of oven 40. Oven assembly 40 also includes a flue stack 64 to remove flue gas and other gases which may accumulate within the oven cavity 43. Grating 65 is disposed about the floor of the oven cavity to allow scale matter from the work piece 14 to pass through to a scale trap 66 located therebelow. An access door assembly, generally indicated by the numeral 67 can be located below the scale trap 66 to permit access for removal of the scale matter which has accumulated within the scale trap 66.

The advantages of the disclosed strip mill heat recuperator system 10, and its individual components, may be better recognized by considering the operation thereof as an integral member of a roll mill finishing line. In particular, reference is made to the transition period of the roll finishing process wherein the work piece 14 is exiting the roughing stand 11 and then entering the finishing stand 12.

As the work piece 14 exits the rollers 15 from the roughing table 11, the leading edge thereof is directed downwardly by the first concave surface 16 of the deflector 13. Proximity switch 21 senses the presence of the work piece 14 and sends a signal to a suitable control system which retracts both clamp assemblies 22 and 23 to provide the maximum opening therebetween for the work piece 14 to pass. Guide surfaces 32 and 33 aid in guiding the work piece into the aforementioned opening. As the work piece continues to exit the roughing stand 11, the leading edge thereof engages the driven pinch rolls 36 which advance the work piece 14 downwardly into the opening 41 in the roof 42 of the oven assembly 40.

The work piece 14 passes through the spacing between the guide surfaces 50 and 51 of the oscillating guides 44 and 45, respectively, as the latter are driven in an oscillating pendular motion. As such, a sinusoidal motion is imparted upon the work piece 14 which causes it to assume a foldedly layered configuration as it comes to rest on the grating 65 within the oven cavity 43, as illustrated in FIG. 1. Thus it should be appreciated that as the work piece 14 continues to exit the roughing stand 11, it is continually accumulated in the aforementioned foldedly layered configuration within the oven cavity 43. Throughout this period, the oven cavity 43 is maintained at a constant desired temperature. For example, in the case of roll finishing steel, the desired temperature may be approximately 1800° F. (982° C.).

The foregoing process continues until the entire work piece 14 has exited the roughing stand 11. When the proximity sensor 21 senses the tail end of the work strip 14, the control system stops the downward movement of the work strip 14 by simultaneously disengaging the pinch rolls 36 and the oscillating guides 44 and 45, and orienting the clamp assemblies 22 and 23 into an abutting engagement with the work piece 14, thus clamping the latter between the opposing faces 30 and 31.

At this juncture in the sequence, substantially the entire work piece 14 is contained within the heated oven cavity 43, and the tail end of the work piece is positioned substantially below the trailing edge of the deflector 13. The control system then preferably causes the second clamp head 27 to fully retract and the first clamp head 26 to extend to its full stroke position, thus aligning the tail end of the work section 14 with the second concave surface 17 of the deflector 13. The pinch rolls 36 are then reversibly energized and the work piece 14 is advanced upwardly toward the deflector 13. Accordingly, the second concave surface 17 directs the work piece 14 toward the feed rollers 20 for the finishing stand 12.

As the work piece 14 advances into the finishing stand 12, it is withdrawn from the oven assembly 40 through the opening 41 in the roof 42 thereof. The oscillating guides 44 and 45, with the reciprocating actuator deenergized, pivot freely to follow the orientation of the work piece 14 from the foldingly layered configuration thereby directing it through the opening 41. Throughout this process, scale matter which may have formed on the surface of the work piece 14 is removed as a result of the work piece 14 impacting against the interior surfaces of the oven cavity 43 and further as a result of the abrasive movement of the work piece 14 through the oscillating guides 44 and 45. The scale matter thus removed is permitted to fall through the interstices of the grating 65 into the scale trap 66 where it could subsequently be removed.

It should be noted that once the work piece 14 has engaged the feed rollers 20 for the finishing stand 12, it may no longer be necessary to employ the pinch rolls 36 to advance the work piece 14, this being accomplished by the feed rollers 20 and the action of the finishing stand 12. As such, the control system can disengage the pinch rolls 36 and retract the positioning actuator 37, thus allowing the work piece to pass free therethrough.

After the work piece 14 has been drawn completely into the finishing stand 12, the strip mill heat recuperator system 10 can be readied to begin another cycle. Namely, clamp heads 26 and 27 can be withdrawn to their fully retracted position; the pinch rolls 36 can be re-engaged to their original rotation; and the oscillating guides 44 and 45 can be reactivated to their original pendular motion.

While the foregoing description pertains to a cycle wherein the work piece 14 is withdrawn from the roughing stand 11 and introduced into a separate and distinct finishing stand 12, it is likewise possible to effectuate other types of cycles. Particularly, in certain types of roll finishing mills, such as a Steckel mill, it may be desirable to run the work piece back and forth through a single finishing stand. It should be appreciated that the strip mill heat recuperator system 10 of the present invention is readily adaptable for such a finishing cycle. Specifically, at that juncture of the cycle when the work piece 14 is being withdrawn from the oven assembly 40, the first clamp head 26 may be fully retracted or extended while the second clamp head 27 is fully extended or retracted. As such, the work piece 14 is directed vertically onto either concave surface 16 or 17 which could thus direct the work piece 14 in either direction.

It should also be noted that this invention could be adapted to service two strips of material at one time. For example, by merely elongating oven 40 so that it was situated under two work pieces 14 and by providing a second set of deflectors, clamps and the like, one oven could service two lines.

Thus, it should be evident that a strip mill heat recuperator system according to the concept of the invention disclosed herein carries out the various objects of the invention and otherwise constitutes an advantageous contribution to the art.

I claim:

1. Apparatus for maintaining the temperature of an intermediate product of a strip metal rolling mill, comprising:

oven means to receive the intermediate product from the strip metal rolling mill;

deflector means to direct the intermediate product from the strip metal rolling mill to said oven means;

guide means within said oven means oscillating to positively dispose the intermediate product in a foldedly layered configuration within said oven means, said guide means including co-pendular elements oriented relative to each other on individual pivotal shafts and having opposingly oriented parallel surfaces defining therebetween a region through which the intermediate product may pass; and pinch roll means for selectively advancing or withdrawing the intermediate product relative to said oven means;

said deflector means further directing the intermediate product from said oven means to the strip metal rolling mill.

2. Apparatus according to claim 1 wherein said oven means is a substantially enclosed structure having an opening in the roof thereof for the influx and efflux of the intermediate product, heater means to maintain a constant uniform desired temperature, and exhaust means for the removal of flue gas and other gases which may accumulate within said oven means.

3. Apparatus according to claim 2 further comprising first grating means disposed about said oven means for the introduction of heat into said oven means from said heater means, second grating means disposed about the floor of said oven means to permit scale from the intermediate product to pass therethrough; and a scale trap chamber positioned relative to said grating means to receive the scale from the intermediate product; and access means to permit removal of the scale from said scale trap chamber.

4. Apparatus according to claim 1 further comprising clamp means to selectively secure one end of the intermediate product when the intermediate product is substantially contained within said oven means.

5. Apparatus according to claim 4 wherein said clamp means selectively orients the intermediate product relative to said deflector means.

6. Apparatus according to claim 1 further comprising sensor means to determine the presence of the intermediate strip.

7. Apparatus according to claim 1 wherein said deflector means includes a first concave surface to direct the intermediate product from the rolling mill to said oven means and a second concave surface to direct the intermediate product from said oven means back to the rolling mill.

8. A method for maintaining a uniform temperature of an intermediate product of a strip metal rolling mill comprising the steps of:

transferring the intermediate product from the strip metal rolling mill to an oven;

selectively advancing the intermediate product relative to the oven;

passing the intermediate product between copendular, oscillating elements within the oven so as to positively dispose the intermediate product in a foldedly layered configuration within the oven;

selectively withdrawing the intermediate product relative to the oven; and transferring the intermediate product from the oven to the strip metal rolling mill.

9. A method as set forth in claim 8 further comprising the step of sensing the presence of the intermediate product as it is being transferred from the rolling mill.

10. A method as set forth in claim 9 further comprising the step of removing scale from the intermediate product prior to its being transferred from the oven.

11. A method as set forth in claim 10 further comprising the step of maintaining the oven at a predetermined constant temperature.

* * * * *